US010455889B2

(12) United States Patent
Krumbeck et al.

(10) Patent No.: US 10,455,889 B2
(45) Date of Patent: Oct. 29, 2019

(54) SKI BOOT

(71) Applicant: MARKER Deutschland GmbH, Penzberg (DE)

(72) Inventors: Markus Krumbeck, Farchant (DE); Michael Mangold, Grainau (DE)

(73) Assignee: MARKER Deutschland GmbH, Penzberg (DE)

( * ) Notice: Subject to any disclaimer, the term of this patent is extended or adjusted under 35 U.S.C. 154(b) by 243 days.

(21) Appl. No.: 15/184,365

(22) Filed: Jun. 16, 2016

(65) Prior Publication Data

US 2017/0196299 A1 Jul. 13, 2017

(30) Foreign Application Priority Data

Jan. 13, 2016 (EP) ..... 16151151

(51) Int. Cl.
*A43B 5/04* (2006.01)
*A43B 13/22* (2006.01)
(Continued)

(52) U.S. Cl.
CPC ..... *A43B 5/047* (2013.01); *A43B 5/0413* (2013.01); *A43B 5/0419* (2013.01);
(Continued)

(58) Field of Classification Search
CPC ... A43B 5/0403; A43B 5/0411; A43B 5/0413; A43B 5/047; A43B 5/0482; A43B 5/0492; A43B 5/0494
(Continued)

(56) References Cited

U.S. PATENT DOCUMENTS 4,505,056 A * 3/1985 Beneteau ..... A43B 13/141 36/117.2
5,088,756 A * 2/1992 Hue ..... A63C 9/20 280/607
(Continued)

FOREIGN PATENT DOCUMENTS

DE 102011009118 A1 7/2012
WO 2013168110 A1 11/2013

OTHER PUBLICATIONS

Extended EPO Search Report for patent app. EP 16151151.4 dated Jun. 22, 2016, 9 pages.
(Continued)

*Primary Examiner* — Sharon M Prange
(74) *Attorney, Agent, or Firm* — Luedeka Neely Group, P.C.

(57) ABSTRACT

A ski boot, comprising: a rigid ski boot shell; and a sole of the ski boot which comprises a free upper side, which protrudes forwards in the longitudinal direction of the boot and/or laterally beyond the ski boot shell, and a lower side, wherein the ski boot comprises a front attaching region which co-operates with a front part of a ski binding in order to secure the ski boot, and a front region of the ski boot stands upright on a planar base via the front attaching region, wherein the upper side of the sole exhibits a distance, orthogonally with respect to the base, of at least 25 mm at a front end of the sole of the ski boot, and the upper side of the sole has a distance from the lower side of the sole, measured perpendicular to the base, of 19 mm±2 mm at a distance from the front end of the sole, measured in the longitudinal direction, of at least 28 mm, and wherein, with the ski boot standing upright on the base, the lower side of the sole has a distance from the base of at least 5 mm
(Continued)

Figure 1:
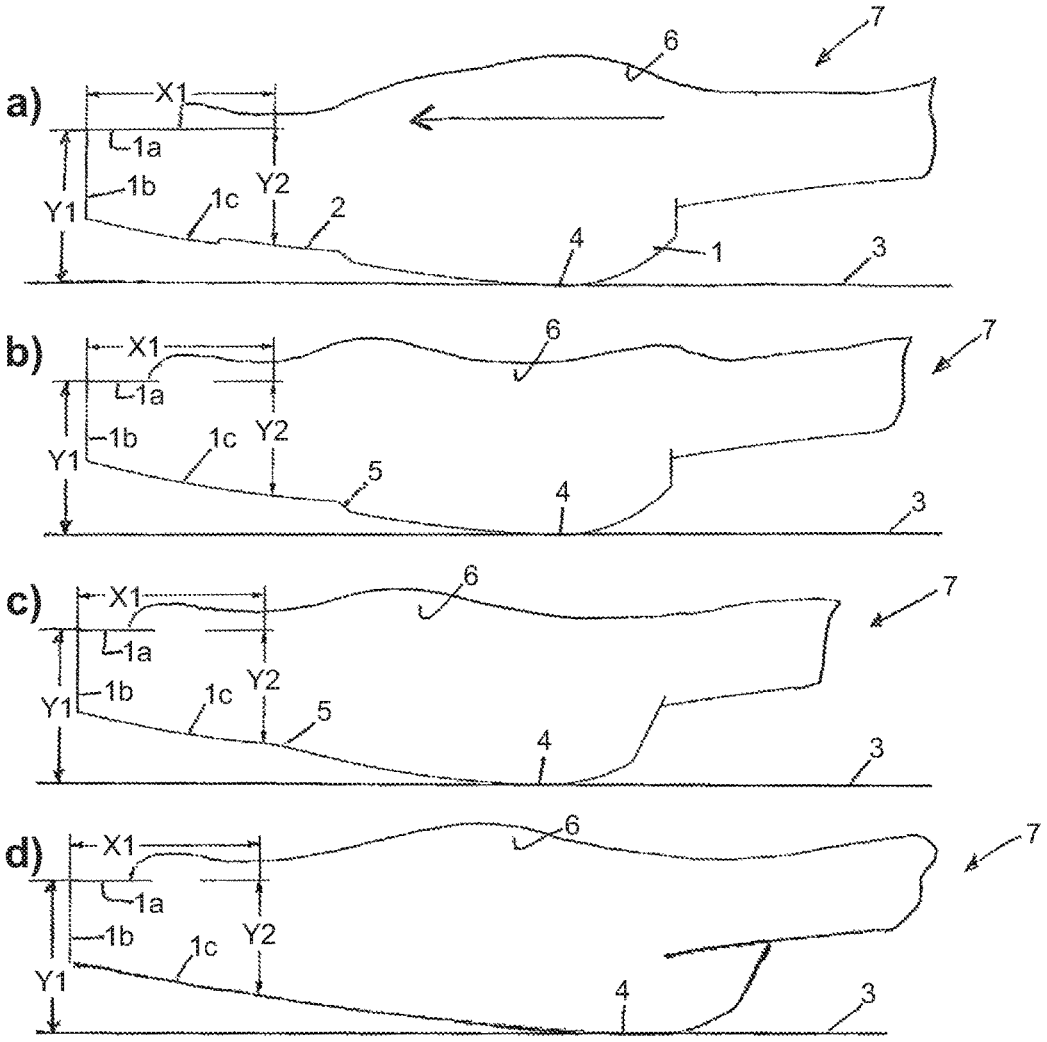

throughout, up to a distance of 40 mm±10 mm from the front end of the sole, as measured in the longitudinal direction.

10 Claims, 2 Drawing Sheets

(51) Int. Cl.
*A43B 13/28* (2006.01)
*A43B 13/14* (2006.01)
*A43B 13/02* (2006.01)

(52) U.S. Cl.
CPC ..... *A43B 5/0421* (2013.01); *A43B 5/0482* (2013.01); *A43B 5/0486* (2013.01); *A43B 5/0494* (2013.01); *A43B 5/0496* (2013.01); *A43B 13/02* (2013.01); *A43B 13/145* (2013.01); *A43B 13/22* (2013.01); *A43B 13/28* (2013.01)

(58) Field of Classification Search
USPC ..... 36/117.2, 117.3
See application file for complete search history.

(56) References Cited

U.S. PATENT DOCUMENTS 5,845,421 A * 12/1998 Tanaka ..... A43B 5/0401 36/117.3
6,202,326 B1 * 3/2001 Hauglin ..... A43B 5/0415 36/117.2
6,247,252 B1 * 6/2001 Parisotto ..... A43B 5/04 36/117.2
6,409,204 B1 * 6/2002 Ayliffe ..... A43B 5/0494 36/117.2
7,810,258 B2 * 10/2010 Narajowski ..... A43B 5/0492 36/117.2
9,161,589 B2 * 10/2015 Parisotto ..... A43B 5/0494
2008/0272577 A1 * 11/2008 Kogler ..... A63C 9/20 36/117.3
2009/0255149 A1 * 10/2009 Rigat ..... A43B 1/0018 36/117.3
2010/0313448 A1 * 12/2010 Girard ..... A43B 5/0413 36/117.3

OTHER PUBLICATIONS

Saloman launches its application of Amer Sports' new standard for compatibility of touring boot soles and bindings, Outside Media, http://www.outsidemedia.com/2013/01/salomon-launches-its-application-of-amer-sports-new-standard-for-compatibility-of-touring-boot-soles-and-bindings/, published Jan. 15, 2013.
Diamir, Service Manuel for specialist dealers, original French version located at http://tinyurl.com/hb3k4yb, May 31, 2010.
Giaccone, Loic, Dr. Matos: Norms and standards, original French version located at http://www.skipass.com/news/117382-dr-matos-les-normes-et-standards.html, Mar. 25, 2015.

* cited by examiner

SKI BOOT

This application claims the benefit of the earlier filing date of European patent application 16 151 151.4, filed Jan. 13, 2016.

The invention relates to a ski boot, comprising: a rigid ski boot shell; and a sole of the ski boot which comprises a free upper side, which protrudes forwards and/or laterally beyond the ski boot shell, and a lower side. The ski boot comprises a front attaching region which can be moved into binding engagement with a front part of a ski binding in order to secure the ski boot. With the ski boot standing freely on a planar base, the free upper side of the sole exhibits a distance from the base, orthogonally with respect to the base, of at least 25 mm at a front end of the sole of the ski boot. With the ski boot standing freely on the planar base, the free upper side of the sole exhibits a distance from the lower side of the sole, measured perpendicular to the base, of 19 mm±2 mm at a distance from the front end of the sole, measured in the longitudinal direction, of at least 28 mm and at most 34 mm. With the ski boot standing freely on the base, the lower side of the sole has a distance from the base of at least 5 mm throughout, up to a distance of 40 mm±10 mm from the front end of the sole, as measured in the longitudinal direction. The invention also relates to the sole of the ski boot as a semi-finished product.

The design of touring ski boots for adults is specified in DIN ISO 9523 of 30 Oct. 2009. The design of downhill or Alpine ski boots is regulated by DIN ISO 5355 of 16 Feb. 2006. Each of these two standards specifies dimensions, together with corresponding tolerances, for the front attaching region of a ski boot standing freely on a planar base, in which the ski boot is connected to the toe retainer, and for a rear attaching region in which the ski boot is connected to the heel retainer.

In keeping with the standards, one must necessarily change ski boots when switching from an Alpine ski to a touring ski, since a downhill ski boot according to DIN ISO 5355 cannot be held in the binding of a touring ski and a touring ski boot according to DIN ISO 9523 cannot be held in the binding of a downhill ski.

It would be desirable to have a ski boot which is designed in such a way that the user can use a ski comprising a purely downhill ski binding and a touring ski comprising a corresponding touring ski binding with the same ski boot without any problems, without changing the ski boot.

It is an object of the invention to provide a ski boot or a sole for a ski boot which is designed in such a way that the same ski boot can be used with a downhill ski binding for descent and with a touring binding for touring.

This object is solved in accordance with the invention by the ski boot disclosed herein and the sole of the ski boot disclosed herein.

The dependent claims relate to features which, individually or in combination, are suitable for advantageously developing the subject-matter of the independent claims, wherein features of the dependent claims can develop any subject-matter of an independent claim, where expedient, irrespective of the independent claim to which they are directly assigned and irrespective of the category of the independent claims.

A first aspect relates to a ski boot, comprising: a preferably rigid ski boot shell; and a sole of the ski boot which comprises a free upper side which protrudes forwards in the longitudinal direction of the boot and/or laterally beyond the ski boot shell transverse to the longitudinal direction of the boot. The sole of the ski boot comprises a lower side of the sole. The ski boot also comprises a front attaching region which co-operates with a front part, a front jaw or a toe retainer of a ski binding in order to secure the ski boot, wherein the front attaching region moves the ski boot into binding engagement with the front part of the binding, and the ski boot stands upright on a planar base via the front attaching region in at least one portion. In accordance with the standards, "base" is understood here to mean a level surface onto which the ski boot is placed freely, i.e. without being fastened on the base or weighed down, in order to check the following measurements.

At a front end of the sole of the ski boot, the free upper side of the sole of the ski boot has a distance from the planar base, measured orthogonally with respect to the base, of at least 25 mm. Preferably, it has a distance of 28 mm±3 mm. The front end of the sole of the ski boot is aligned substantially perpendicular to a longitudinal direction of the ski boot and lies for example on an abutment formed by the toe retainer when it is held in the binding or when the user steps into the binding.

The free upper side of the sole of the ski boot has a distance from the sole of the ski boot, measured perpendicular to the base, of 19 mm±2 mm at a distance from the front end of the sole of the ski boot, measured in the longitudinal direction of the ski boot, of at least 28 mm and at most 34 mm, preferably 31 mm±3 mm, particularly preferably 32 mm±2 mm, in particular 32 mm±1 mm; preferably, the distance from the sole of the ski boot, measured perpendicular to the base, is 19 mm±1 mm, i.e. a distance from a plane, which includes the upper side of the sole of the ski boot, to a lower side of the sole via which the ski boot for example contacts the ground during walking, is 19 mm±2 mm, preferably 19 mm±1 mm, at the distance from the front end of the sole of the ski boot, measured in the longitudinal direction of the ski boot, of 30 mm+4 mm/−2 mm, i.e. between 28 mm and 34 mm. The permissible tolerance for the vertical distance can also be smaller than 1 mm, for example 0.5 mm or 0.3 mm.

With the ski boot standing freely upright on the planar base in a standing region, the sole of the ski boot or, respectively, the lower side of the sole has a clear distance from the planar base of at least 5 mm throughout, up to a distance from the front end of the sole of the ski boot of at least 30 mm, preferably 40 mm±10 mm, as measured in the longitudinal direction. This distance can be measured using a test piece or gauge, such as for example by means of a cuboid exhibiting a constant height of 5 mm, which is pushed under the ski boot standing freely upright on the planar base or, respectively, under the sole of the ski boot, from the front side of the sole or the front end of the sole of the ski boot. Once an upper front edge of the cuboid contacts the sole of the ski boot, the cuboid cannot be pushed any further under the ski boot without then lifting the ski boot off the base. The length of the cuboid which lies beneath the ski boot when this point of contact is reached is then measured and should preferably be within the aforementioned range of 40 mm±10 mm.

The ski boot generally also comprises a rear attaching region and a rear standing region via which the rear end or heel end of the ski boot stands upright on the planar base and via which the ski boot can be secured in the binding on a ski by a heel retainer, for example for descent. The rear attaching region is not however considered in any more detail within the framework of the invention. Reference is made in this respect to known ski bindings.

The sole of the ski boot or, respectively, a virtual enveloping area which spans the sole of the ski boot can be formed as a straight or concave, in particular slightly curved area, in a region from the front end of the sole of the ski boot up to a first point of contact between the ski boot standing freely on the planar base and the base, wherein the area can be curved in the longitudinal direction of the ski only or in and transverse to the longitudinal direction of the ski. The "point of contact" denotes the point or line or area of the sole of the ski boot via which the sole of the ski boot first contacts the base in the front attaching region. If the ski boot is cut open along its longitudinal centreline, the sectional view of the sole of the ski boot or, respectively, of a lower side of the sole facing the base can appear as a straight or curved line, preferably a concave line which is curved in the direction of the base.

That the straight or curved area and/or the corresponding straight line or curved line is formed by the virtual enveloping area can mean that the sole of the ski boot itself exhibits a profile and that the sole of the ski boot only exhibits the linear or surface shape described in that a virtual envelope is conceptually placed over the profile. The profile can advantageously be embodied such that walking with no skis is facilitated and preferably also such that the risk of slipping while walking is reduced.

The sole of the ski boot can also be formed from two or more straight or correspondingly slightly curved areas, wherein the latter appear in the cross-section described above as two or more lines, preferably curved in the direction of the base, wherein the at least two straight or curved lines can transition into each other in a more or less pronounced step.

The sole of the ski boot can comprise a two-dimensional recess in a region between the front end of the sole of the ski boot and the point of contact between the sole of the ski boot and the planar base.

The sole of the ski boot can also comprise an area, preferably a line or a point, which has a distance from the base of exactly 5 mm. This line or point can be formed in the region of the step which connects two curved areas, or within the two-dimensional recess. If the point is formed within the two-dimensional recess, it is preferably formed in a region of the two-dimensional recess which is a front region in the skiing direction.

The two-dimensional recess can recoil by 0.1 mm to 3 mm, preferably 0.3 mm to 2 mm, relative to the lower side of the sole which surrounds it. It can also protrude into the lower side of the sole in the shape of a wedge, such that at least one side of the two-dimensional recess, in particular the side facing the front end of the sole of the ski boot, does not recoil relative to the sole of the ski boot and/or the lower side of the sole. The depth of recoil can exhibit a lesser degree in a region of the two-dimensional recess near the front side of the sole than in a region away from the front side of the sole.

The two-dimensional recess can be polygonal, oval or circular in shape, or can exhibit any other shape. The side walls of the two-dimensional recess can be straight, i.e. aligned substantially perpendicular to the lower side of the sole or the virtual envelop which covers the lower side of the sole, or one or all of the walls can extend obliquely or in steps. The bottom of the two-dimensional recess can be substantially level or can be concavely or convexly curved or profiled and/or can comprise regions separated by steps or can comprise any other structure and/or exhibit any other shape.

Like the shape of the two-dimensional recess, the size of the area of the two-dimensional recess can also be chosen at will, albeit expediently. The two-dimensional recess can thus for example be square with an edge length of for example 20 mm or rectangular with a length in the longitudinal direction of the boot of for example 25 mm and a width in the transverse direction of the boot of for example 40 mm or round with a diameter of for example 50 mm or oval, with or without an axis of symmetry, etc. The decisive factors are functional aspects, manufacturing costs and, to a minor degree, weight. These aspects can be supplemented by design elements.

The two-dimensional recess can also extend over the entire width of the sole of the ski boot and can be open at the two outer sides, i.e. the sides which point transverse to the longitudinal direction and extend substantially parallel to the longitudinal direction. The two-dimensional recess then forms a sort of groove which extends transverse to the longitudinal axis of the ski boot over the entire width of the ski boot and opens out into the surrounding environment.

In the region from the front end of the sole of the ski boot up to the point of contact between the sole of the ski boot and the base, the sole of the ski boot can be formed from a material and/or comprise regions of for example different hardness or different sliding properties. Alternatively, said region can also comprise portions which are formed from different materials which differ in terms of their physical properties such as hardness, frictional resistance, elasticity, etc.

The two-dimensional recess can in particular be formed from a material which exhibits material properties which deviate from the sole of the ski boot, wherein the two-dimensional recess can be fashioned out of the sole of the ski boot and its surface can be refined by subsequent processing such as for example lacquering, compacting, grinding, etc., or the two-dimensional recess can be a separately manufactured component, for example a shell-shaped component, which is for example inseparably connected to the sole of the ski boot, for example integrated with it in an injection process, or latterly joined to it, as the sole of the ski boot is being manufactured.

The two-dimensional recess can in particular comprise a region for resting the ski boot on a bearing structure of a front jaw of a downhill ski binding and can preferably not impede but rather in particular assist laterally releasing the downhill ski binding.

The sole can be fashioned out of a block of material or can for example be embodied as a solid body made of one material using an injection process or injection moulding process. The material can be a plastic, wherein the plastic can comprise additives made of another material. A "solid body" is also to be understood to mean a body which is constructed from multiple layers of material or which comprises regions made of different material. What is different to a solid body is a skeletal or supporting construction with corresponding hollow spaces which are not filled or which are filled with a gas or gel or which can be filled with foam using a suitable material. The sole of the ski boot can alternatively be embodied as a flat semi-finished product which is mounted on and joined—for example, glued or fused—to a skeleton manufactured together with the ski boot shell.

The region of contact with the bearing structure of the front jaw of the downhill ski binding, such as for example the recess, or, respectively, a trough which forms the two-dimensional recess can be formed from a different material or comprise a different material to the rest of the sole of the ski boot, i.e. the region of contact can be an insert which is inserted into a cavity or hollow formed in the sole and is preferably joined to the sole captively, non-detachably or such that it cannot be removed again without being destroyed.

The material of the sole can for example be injected around the insert, or the insert can be fused or glued to the sole of the ski boot or connected to the sole of the ski boot in a positive and/or force fit. Particularly when the sole of the ski boot consists of a solid material, the shell can be integrated into the material of the sole of the ski boot. If the sole of the ski boot consists of a supporting construction comprising an outer skin of the sole, as already described above, this outer skin of the sole is preferably manufactured from a material which is at least slightly elastic and which can harden after or as it is connected to the supporting construction. The material can be additionally reinforced in the region of the recess, for example by local material thickening, integrated reinforcing elements and/or admixtures to the material which alter its properties, such as for example its stiffness and hardness, relative to the material of the rest of the outer skin of the sole.

The material of the outer skin of the sole in the region of the recess can then for example be harder, less susceptible to abrasion, more conducive to sliding, and the surface can be more compacted than outside said region. This means that when the binding is released transversely, the ski boot does not offer any additional resistance counteracting the release force set, and that as far as possible, no snow remains stuck to the ski boot in the region of the recess.

The front attaching region of the ski boot substantially corresponds to the specifications of both DIN ISO 5355 and DIN ISO 9523 on the date of the application.

The downhill ski binding can comprise a front jaw comprising sole retainers which press onto the free surface of the touring sole from the front and/or from the side and/or from above, in order to fixedly connect the ski boot to the ski. The front jaw can comprise pins which engage with pin receptacles formed laterally on the touring sole, in order to connect the ski boot to the ski.

The embodiment of the sole of the ski boot described on the preceding pages, in conjunction with a downhill ski binding comprising a correspondingly prepared front jaw or a significantly arched bearing structure which is separate from the front jaw, enables the ski boot in accordance with the invention to reliably connect the user to the downhill ski in the downhill binding, without having to embody the front jaw to be height-adjustable.

Another aspect of the invention relates to a sole of the ski boot which comprises a front attaching region and a rear attaching region, wherein the front attaching region is embodied such that its measurements correspond to both DIN ISO 5355 and DIN ISO 9523 as current at the time of the application. The sole of the ski boot can be originally moulded together with a shaft of the ski boot, i.e. manufactured in one piece in a die, for example in an injection moulding process. The sole of the ski boot can alternatively be manufactured separately and placed into the die as a semi-finished product and fixedly connected to the shaft of the ski boot in the injection moulding process. The sole of the ski boot can however also be manufactured separately and designed to be permanently joined, in a second processing step, to a shaft of the ski boot or to a skeletal or underlying construction for the sole which the shaft of the ski boot includes.

The sole of the ski boot is in particular a sole of the ski boot such as has been described with respect to the ski boot of the first aspect, comprising one or more of the features disclosed therein.

In the following, an example embodiment of the invention is described on the basis of figures. The scope of the invention is not limited to the example embodiment shown. Features or combinations of features essential to the invention which can only be gathered from the figures can advantageously develop the invention and form part of the scope of the disclosure.

Figure 2:
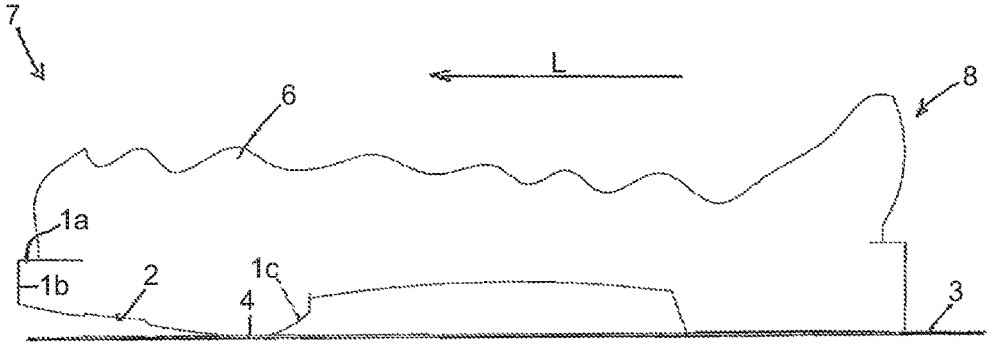

Individually, the figures show:

FIG. 1 four sketched embodiments of a front attaching region of the sole of the ski boot according to the invention;

FIG. 2 the sole of the ski boot with a recess, in accordance with FIG. 1*a;*

Figure 3:
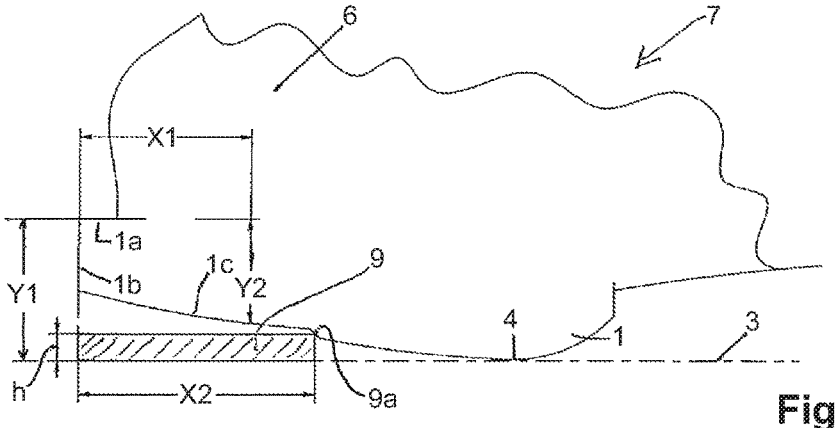

FIG. 3 the front attaching region with a step, in accordance with FIG. 1*b;*

Figure 4:
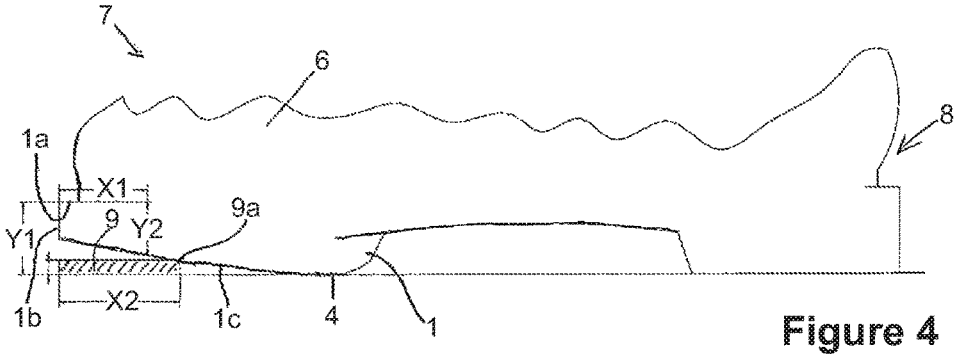

FIG. 4 the sole of the ski boot with no recess or step, in accordance with FIG. 1*d,*

Figure 5:
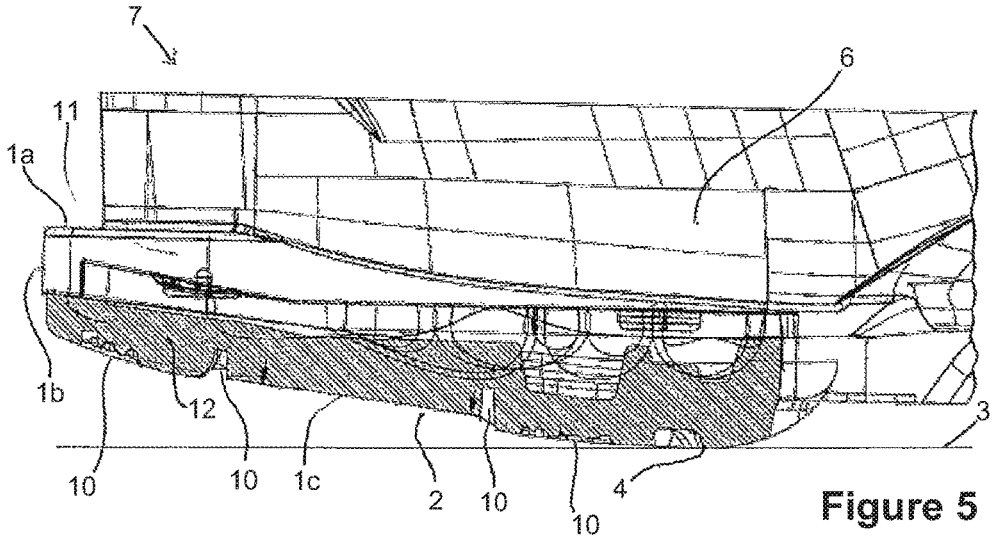

FIG. 5 a design sketch of a front attaching region of a ski boot with a sole, in accordance with FIG. 1*a.*

FIG. 1 shows different embodiments of a front attaching region 7 of a ski boot comprising a sole 1 of the ski boot in accordance with the invention, in a sectional view in each case. Each of the sections transects the ski boot centrally in the longitudinal direction X.

The sole 1 of the ski boot comprises a free upper side 1*a* of the sole which protrudes at least forwards beyond the ski boot shell 6 which is only suggested. The sole 1 of the ski boot comprises a front end 1*b* and a lower side 1*c* of the sole. During walking in the ski boot with no ski, the lower side 1*c* of the sole contacts the ground and thus also forms a running surface for the ski boot. In each of FIGS. 1*a* to 1 *d*, the ski boot is standing freely on a planar base 3 and contacts the base 3 in a point of contact 4 or, respectively, a line or area of contact.

FIG. 1*a* shows a front attaching region 7 of a ski boot comprising a sole 1 of the ski boot, wherein a portion of the sole 1 of the ski boot between the front end 1*b* and the point of contact 4 comprises a recess 2 which recoils relative to the sole 1 of the ski boot which surrounds it. The shape of the recess 2 can be freely chosen. The recess 2 can be surrounded on all sides by the sole 1 of the ski boot or can be formed such that it is continuous from one side of the ski boot up to the other side of the ski boot, transverse to a longitudinal direction X, and open out into the surrounding environment on both sides. In the sectional view, the regions of the sole of the ski boot in front of and behind the recess 2 in the longitudinal direction X can be straight or slightly curved concave lines.

FIG. 1*b* shows a front attaching region 7 of a ski boot comprising a sole 1 of the ski boot, wherein a portion of the sole 1 of the ski boot between the front end 1*b* and the point of contact 4 is formed from two mutually abutting regions, and a step 5 connects the two regions to each other. In the sectional view, each of the two regions is shaped as a slightly curved concave line, while the step 5 is significantly pronounced.

FIG. 1*c* shows a front attaching region 7 of a ski boot comprising a sole 1 of the ski boot, wherein a portion of the sole 1 of the ski boot between the front end 1*b* and the point of contact 4 is formed from two mutually abutting regions, as in the sole 1 of the ski boot in FIG. 1*b*. In this case, the two regions are again connected to each other in a step 5, wherein the step 5 is less pronounced than in FIG. 1*b*.

FIG. 1*d* shows a front attaching region 7 of a ski boot comprising a sole 1 of the ski boot, wherein a portion of the sole 1 of the ski boot between the front end 1*b* and the point of contact 4 is depicted, in the sectional view, as a continuous straight or slightly curved concave line.

It holds for all of FIGS. 1*a* to 1 *d* that a distance Y1 between the upper side 1*a* of the sole 1 of the ski boot at the front end 1*b* of the sole 1 of the ski boot and the base 3, as measured orthogonally with respect to the base 3, is greater than or equal to 25 mm and preferably measures 28 mm±3 mm. This measurement corresponds to the standard measurement in this point for touring ski boots.

At a distance X1, measured in the longitudinal direction X, of approximately 30 mm±2 mm, a distance Y2 from the upper side 1*a* of the sole 1 of the ski boot to the lower side 1*c* of the sole, as measured orthogonally with respect to the base 3, measures approximately 19 mm±1 mm and preferably 19 mm±0.5 mm. The distance Y1 corresponds to the standard for downhill ski boots, where it is the distance between a free upper side 1*a* of the sole 1 of the ski boot and a base.

FIG. 2 is another sectional view, showing the lower part of a ski boot comprising the front attaching region 7, a rear attaching region 8 and the sole 1 of the ski boot. The sole of the ski boot in the front attaching region 7 corresponds substantially to the sole 1 of the ski boot in FIG. 1*a*. FIG. 2 illustrates how the sole 1 of the ski boot according to the invention, due to its dimensions in the front attaching region 7, is better suited to walking with no skis than the known sole of a downhill ski boot, since the shape of the sole 1 of the ski boot better enables the foot to roll off during walking. The sole 1 of the ski boot can additionally comprise a profile which further facilitates walking with no skis and/or which has an anti-slip effect. A ski boot comprising a sole of the ski boot with such a profile is shown by way of example in FIG. 5.

FIG. 3 is likewise a sectional view, showing the front attaching region 7 of a ski boot such as is already known from FIG. 1*b*. In FIG. 3, a test piece 9 is additionally indicated which is shaped as a cuboid with a standardised height of 5 mm throughout. The test piece 9 can be pushed under the ski boot in the longitudinal direction X from the front end 1*b* of the sole 1 of the ski boot. The shape of the sole 1 of the ski boot causes an upper edge 9*a* of one end of the test piece 9 to contact the sole of the ski boot in at least one point at a distance X2 of 40 mm±10 mm from the front end 1*b* of the sole 1 of the ski boot, as measured in the longitudinal direction X, i.e. the test piece 9 cannot be pushed any further under the ski boot without then lifting the ski boot off the base 3.

The sectional view in FIG. 4, like that in FIG. 2, shows the lower part of a ski boot comprising the front attaching region 7, the rear attaching region 8, the sole 1 of the ski boot and a truncated part of the ski boot shell 6. The sole 1 of the ski boot corresponds substantially to the sole 1 of the ski boot in FIG. 1*d*. The distance Y1 between the upper side 1*a* of the sole 1 of the ski boot and the base 3, as measured orthogonally with respect to the longitudinal direction X, is at least 25 mm and preferably 28 mm±3 mm. At the distance X1 of 30 mm±2 mm, as measured in the longitudinal direction X, the distance Y2 from the free upper side 1*a* of the sole to the lower side 1*c* of the sole, as measured orthogonally with respect to the longitudinal direction X, measures 19 mm±1 mm in a Y direction. When it lies planar on the base 3, the test piece 9 exhibiting a height h of 5 mm throughout can be pushed under the ski boot, starting from the front end 1*b* of the sole 1 of the ski boot, along the distance X2 of at least 30 mm, preferably 40 mm±10 mm, as measured in the longitudinal direction X, before the front upper edge 9*a* of the test piece 9 contacts the sole 1 of the ski boot.

FIG. 5 is a sectional view showing an example embodiment of a front attaching region 7 of a ski boot, in a detailed design sketch. In the example embodiment shown, the sole 1 of the ski boot is composed of two parts 11, 12, namely a first part 11 which has been manufactured in one piece with the ski boot shell 6, and a preferably separate second part 12 which has been joined to the first part 11 in order to form the sole 1 of the ski boot. The measurements of the distances X1, X2, Y1 and Y2 correspond to the measurements in FIG. 4. The sole 1 of the ski boot or, respectively, the part 12 of the sole of the ski boot comprises a recess 2 and a profile 10. The profile 10 causes the ski boot to stick more securely to the ground during walking with no skis and simultaneously increases the level of comfort during walking, since the profile 10 makes it easier for the foot to roll off during walking movement.

The two parts 11, 12 of the sole 1 of the ski boot can be manufactured from different materials. The part 12 of the sole 1 of the ski boot can be placed, as a semi-finished product, into a moulding die for the ski boot and connected to the ski boot shell 6 in a moulding process. Alternatively, the part 12 of the sole 1 of the ski boot can be joined, in a second processing step, to the ski boot shell 6 which is already finished and which comprises the first part 11 of the sole 1 of the ski boot.

In the example shown, the recess 2 is formed by the part 12 of the sole 1 of the ski boot. Alternatively, the recess 2 can be a separate component which is latterly joined to the sole 1 of the ski boot, irrespective of whether the sole 1 of the ski boot comprises one part or, as in the example embodiment shown, two parts. The recess 2 can in any event exhibit a surface shape or surface quality which for example assists or at least does not impede laterally releasing the downhill ski binding.

LIST OF REFERENCE SIGNS

1 sole of the ski boot
1*a* free upper side of the sole
1*b* front end
1*c* lower side of the sole
2 recess
3 base
4 point of contact
5 step
6 ski boot shell
7 front attaching region
8 rear attaching region
9 test piece
9*a* upper edge
10 profile
11 part of the sole of the ski boot
12 part of the sole of the ski boot
L longitudinal direction
X1 distance
X2 distance
Y1 distance
Y2 distance
h height

The invention claimed is:

1. A ski boot, comprising: a rigid ski boot shell; and a sole of the ski boot which comprises a free upper side, which protrudes forwards in the longitudinal direction of the boot and/or laterally beyond the ski boot shell traverse to the longitudinal direction of the boot, and a lower side, wherein:

(a) the ski boot comprises a front attaching region which can be moved into binding engagement with a front part of a ski binding in order to secure the ski boot;

(b) with the ski boot standing freely on a planar base, the free upper side of the sole exhibits a distance from the base, orthogonally with respect to the base, of at least 25 mm at a front end of the sole of the ski boot;

(c) with the ski boot standing freely on the planar base, the free upper side of the sole has a distance from the lower side of the sole, measured perpendicular to the base, of 19 mm±2 mm at a distance from the front end of the sole, measured in the longitudinal direction, of at least 28 mm and at most 34 mm; and (d) with the ski boot standing freely on the base, the lower side of the sole has a distance from the base of at least 5 mm throughout, up to a distance of 40 mm±10 mm from the front end of the sole, as measured in the longitudinal direction;

(e) wherein the sole of the ski boot comprises a two-dimensional recess in a region from the front end of the sole of the ski boot up to a point of contact with the base;

(f) wherein a point on the sole of the ski boot which exhibits the perpendicular distance of 5 mm from the base lies in the two-dimensional recess; and (g) wherein the two-dimensional recess has a length, measured in the longitudinal direction of the ski, of 20 mm or more and a width, measured transverse to the skiing direction, of 20 mm or more.

2. The ski boot according to claim 1, wherein at the front end of the sole of the ski boot, with the ski boot standing freely on the planar base, the free upper side of the sole has a distance from the base, orthogonally with respect to the base, of 28 mm±3 mm and/or the distance, as measured perpendicular to the base, measures in particular 19 mm±1 mm at a distance of 32 mm±2 mm.

3. The ski boot according to claim 1, wherein the two-dimensional recess recoils by 0.3 mm to 2 mm, on at least three sides, relative to the sole of the ski boot which adjoins it.

4. The ski boot according to claim 3, wherein the recoil is smaller in a region of the two-dimensional recess near the front side of the sole than in a region of the two-dimensional recess away from the front side of the sole.

5. The ski boot according to claim 1, wherein the sole of the ski boot comprises regions of different materials in the region from the front end of the sole of the ski boot up to the point of contact with the base.

6. The ski boot according to claim 1, wherein the two-dimensional recess extends transverse to the skiing direction from one side of the ski boot up to an opposite side of the ski boot.

7. The ski boot according to claim 1, wherein the two-dimensional recess forms a region for resting the ski boot on a bearing structure of a downhill binding.

8. The ski boot according to claim 1, wherein the sole of the ski boot is manufactured independently of the ski boot shell and is joined to the ski boot shell.

9. The ski boot according to claim 1, wherein the front attaching region of the sole of the ski boot can be used with both a downhill ski binding and with a touring binding.

10. A sole of a ski boot for connecting to a ski boot shell to form a ski boot, wherein the sole of the ski boot comprises: a free upper side, which protrudes forwards in the longitudinal direction of the boot and/or laterally beyond the ski boot shell traverse to the longitudinal direction of the boot, and a lower side, wherein:

(a) the ski boot comprises a front attaching region which can be moved into binding engagement with a front part of a ski binding in order to secure the ski boot;

(b) with the ski boot standing freely on a planar base, the free upper side of the sole exhibits a distance from the base, orthogonally with respect to the base, of at least 25 mm at a front end of the sole of the ski boot;

(c) with the ski boot standing freely on the planar base, the free upper side of the sole has a distance from the lower side of the sole, measured perpendicular to the base, of 19 mm±2 mm at a distance from the front end of the sole, measured in the longitudinal direction, of at least 28 mm and at most 34 mm; and (d) with the ski boot standing freely on the base, the lower side of the sole has a distance from the base of at least 5 mm throughout, up to a distance of 40 mm±10 mm from the front end of the sole, as measured in the longitudinal direction;

(e) wherein the sole of the ski boot comprises a two-dimensional recess in a region from the front end of the sole of the ski boot up to a point of contact with the base;

(f) wherein a point on the sole of the ski boot which exhibits the perpendicular distance of 5 mm from the base lies in the two-dimensional recess; and (g) wherein the two-dimensional recess has a length, measured in the longitudinal direction of the ski, of 20 mm or more and a width, measured transverse to the skiing direction, of 20 mm or more.

* * * * *